US008486175B2

(12) United States Patent
Grong et al.

(10) Patent No.: US 8,486,175 B2
(45) Date of Patent: Jul. 16, 2013

(54) GRAIN REFINERS FOR STEEL-MANUFACTURING METHODS AND USE

(75) Inventors: Øystein Grong, Tiller (NO); Casper Van Der Eijk, Trondheim (NO); Gabriella Maria Tranell, Trondheim (NO); Leiv Olav Kolbeinsen, Trondhiem (NO)

(73) Assignee: Sinvent AS, Trondheim (NO)

( * ) Notice: Subject to any disclaimer, the term of this patent is extended or adjusted under 35 U.S.C. 154(b) by 696 days.

(21) Appl. No.: 12/227,826

(22) PCT Filed: May 31, 2007

(86) PCT No.: PCT/NO2007/000189

§ 371 (c)(1),
(2), (4) Date: Apr. 2, 2009

(87) PCT Pub. No.: WO2007/139393

PCT Pub. Date: Dec. 6, 2007

(65) Prior Publication Data

US 2009/0211400 A1 Aug. 27, 2009

(30) Foreign Application Priority Data

May 31, 2006 (NO) ..... 20062484

(51) Int. Cl.

| | |
|---|---|
| ***C22C 29/00*** | (2006.01) |
| ***C22C 32/00*** | (2006.01) |
| ***C22C 38/60*** | (2006.01) |
| ***C22B 9/10*** | (2006.01) |
| ***B22D 11/10*** | (2006.01) |

(52) U.S. Cl.

USPC ..... 75/305; 75/338; 148/541; 148/562

(58) Field of Classification Search

USPC ..... 75/303–250, 255, 252, 253, 254, 75/507–584; 148/400, 401, 300–319, 402–404, 148/320–337, 405–442; 419/10–22; 420/31, 420/42, 87, 129, 590; 428/698, FOR. 139, 428/704, 545, 615–686, 539.5

See application file for complete search history.

(56) References Cited

U.S. PATENT DOCUMENTS 3,635,701 A 1/1972 Davies et al.

(Continued)

FOREIGN PATENT DOCUMENTS

SU 1232688 5/1986

(Continued)

OTHER PUBLICATIONS

B. Craig, "Hydrogen Damage," vol. 13A (Corrosion: Fundamentals, Testing, and Protection), ASM Handbook, ASM International, 2003.*

(Continued)

*Primary Examiner* — Scott Kastler
*Assistant Examiner* — Vanessa Luk
(74) *Attorney, Agent, or Firm* — Wenderoth, Lind & Ponack, L.L.P.

(57) ABSTRACT

The present invention concerns a new type of grain refiners for steel, in the form of a particulate composite material, containing a high volume fraction of tailor-made dispersed particles, with the purpose of acting as potent heterogeneous nucleation sites for iron crystals during solidification and subsequent thermo-mechanical treatment of the steel. The material comprises a composition of particles of $X_aS_b$ or $X_aO_b$ and the element(s) X, where X is one or more elements selected from the group Ce, La, Pr, Nd, Y, Ti, Al, Zr, Ca, Ba, Sr, Mg, Si, Mn, Cr, V, B, Nb, Mo and Fe, and S is sulphur, (O is oxygen), wherein said material additionally contains oxygen, sulphur, carbon and nitrogen, wherein the sulphur (or oxygen) content is between 2 and 30% by weight of said material, while the total content of oxygen (or sulphur), carbon and nitrogen and said other elements selected from the group X is between 98 and 70% by weight of said material, and the said material contains a high volume fraction of finely dispersed $X_aS_b$ or $X_aO_b$ particles embedded in a metallic matrix X. The invention further concerns methods for production and use of the composite material.

21 Claims, 3 Drawing Sheets

Optical micrograph of the manufactured CeS-based PCGR showing yellow CeS particles embedded in a matrix of Ce + Fe.

U.S. PATENT DOCUMENTS

| | | | |
|---|---|---|---|
| 5,217,816 | A | 6/1993 | Brupbacher et al. |
| 6,102,983 | A | 8/2000 | Skaland |
| 6,293,988 | B1 | 9/2001 | Naro |
| 6,733,565 | B1 | 5/2004 | Naro |

FOREIGN PATENT DOCUMENTS

| | | |
|---|---|---|
| WO | 9929911 | 6/1999 |
| WO | 01/57280 | 8/2001 |
| WO | 0157280 | 8/2001 |

OTHER PUBLICATIONS

B. Mishra, "Steelmaking Practices and Their Influence on Properties," ASM Handbook, ASM International, 2002.*

International Search Report issued Sep. 21, 2007 in the International (PCT) Application of which the present application is the U.S. National Stage.

Decision on Grant issued Oct. 27, 2011 in corresponding Russian Patent Application No. 2008152798/02, with English translation.

* cited by examiner

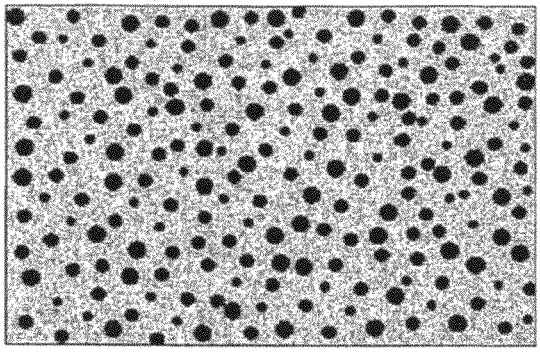
Figure 1. Schematic drawing of a metallographic section of a PCGR showing the particles (black spots) with grain refining capabilities embedded in the parent matrix material (grey regions).
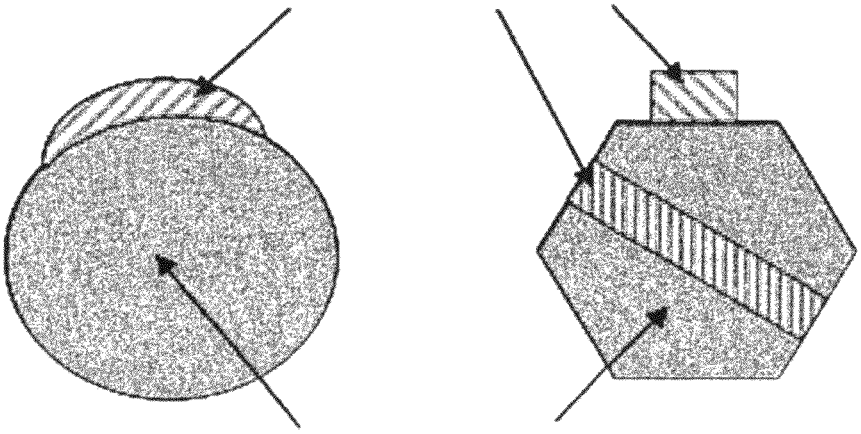
Figure 2. Schematic drawings showing the morphology and multiphase crystalline nature of the particles contained in the PCGRs.

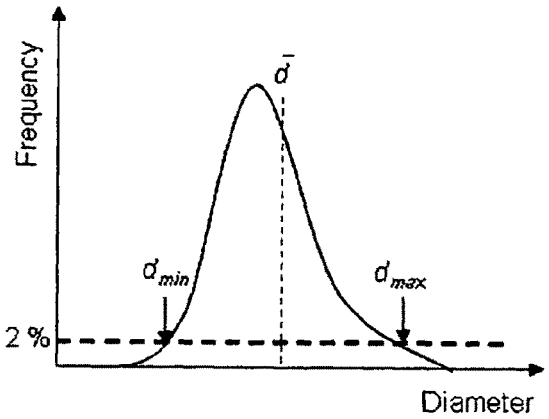
Figure 3. Definition of the three parameters used to characterise the size distribution of particles within the PCGRs.
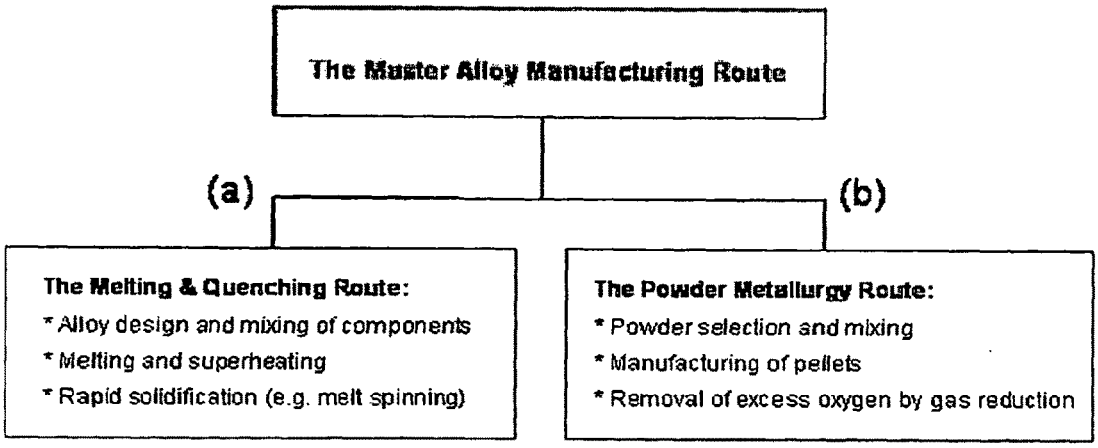
Figure 4. Overview of the different methods used to produce the PCGRs;
(a) The melting & quenching route, (b) The powder metallurgy route.

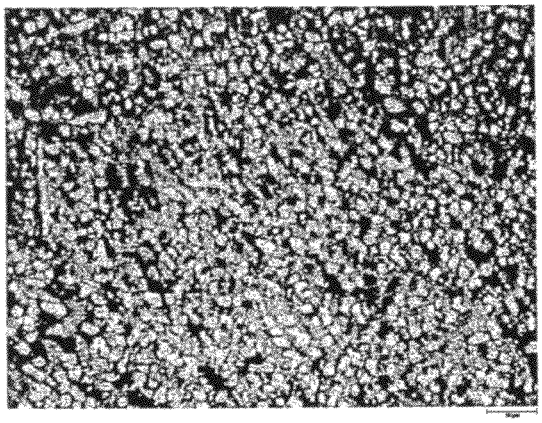
Figure 5. Optical micrograph of the manufactured CeS-based PCGR showing yellow CeS particles embedded in a matrix of Ce + Fe.
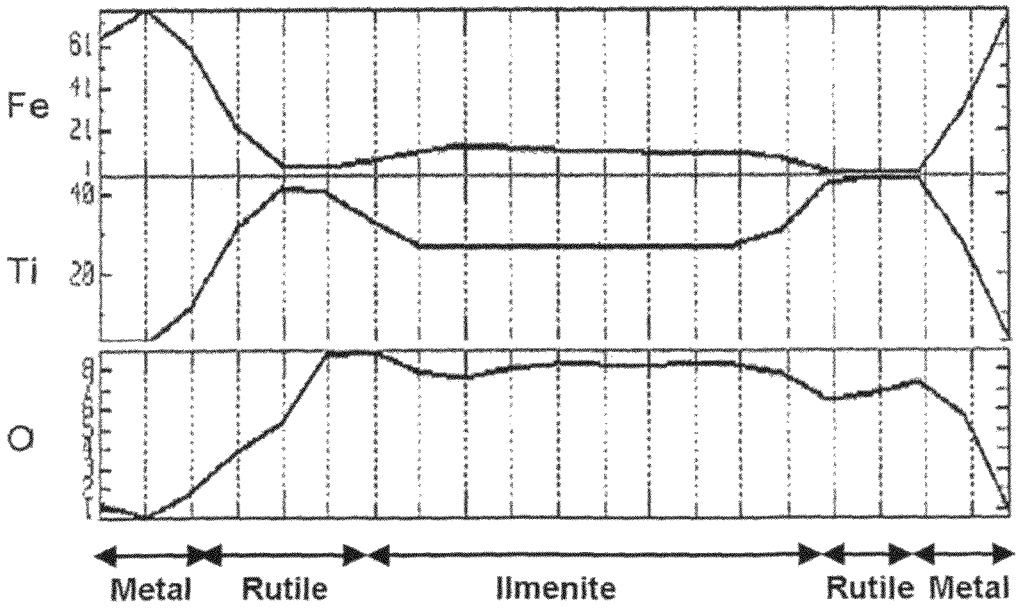
Figure 6

GRAIN REFINERS FOR STEEL-MANUFACTURING METHODS AND USE

INTRODUCTION

The present invention relates to a grain refining composite material for steel, methods of producing such grain refining composites for steel and methods for grain refinement of steel. The steel may be both ferritic and austenitic steels.

BACKGROUND

The demand for higher performance materials with optimum combinations of properties is steadily becoming more critical. For steels, the microstructure controls the resulting mechanical properties and hence, the desired property profile requires the development of a properly adjusted microstructure. The traditional way of producing a fine-grained microstructure yielding the optimum combination of strength and toughness is through thermomechanical processing. By such processing, an effective ferrite grain size well below 5 μm can readily be achieved, even in thick steel plates. In addition, the use of advanced ladle refining techniques for deoxidation and desulphurisation has lead to further quality improvements through a general reduction in the steel oxygen and sulphur contents. The impurity level reflects the amount of non-metallic inclusions being bound as oxides and sulphides in the steel. The harmful effect of inclusions on steel properties arises from their ability to act as initiation sites for microvoids and cleavage cracks during service. Hence, the use of clean steels is normally considered to be an advantage from a toughness point of view.

Inclusions do not always cause a problem in steel. The catalytic effect of the inclusions on the microstructure evolution can be exploited, both during solidification and in the solid state, by virtue of their ability to act as potent heterogeneous nucleation sites for different types of transformation products such as ferrite and austenite. In this case the key issue is to control the inclusion size distribution during the manufacturing stage, which is a major challenge. Therefore, a successful result is contingent upon that both the maximum and minimum diameters as well as the mean size of the inclusions in the as-cast steel can be kept within very narrow (specified) limits.

This is due to two conflicting requirements. On the one hand, a submicron particle size below, say, 0.2 to 0.4 μm implies that the inclusions start to lose their nucleation potency because a curved interface increases the associated energy barrier against heterogeneous nucleation. On the other hand, if the inclusion size is significantly larger than 2 to 4 μm they become detrimental to toughness. At the same time the number density drops rapidly, which, in turn, increases the grain size in the finished steel. Under such conditions the latent grain refining potential in the steel is reduced to an extent which makes grain refinement by inclusions impossible from a transformation kinetic point of view.

In order to promote grain refinement by active inclusions in steels, two possible routes can be followed. The conventional route, which has been extensively explored in the past, is to create the nucleating inclusions within the system during steelmaking by modifying the applied deoxidation and desulphurisation practice. This has lead to the development of new steel grades, where a significant part of the grain refinement is achieved through heterogeneous nucleation of ferrite or austenite at active inclusions following cooling through the different transformation ranges. Unfortunately, uncontrolled coarsening of the inclusions in the liquid steel prior to solidification is still a major problem during industrial steelmaking, meaning that these new steel grades have not found a wide application. However, by following a new route and utilising specially designed grain refiners containing a fine distribution of the nucleating particles (which then are added to the liquid steel before the casting operation), improved conditions for grain refinement can be achieved during subsequent steel processing, without compromising the toughness. This is a well-proven technology in casting of aluminium alloys, which later has been transferred to the ferrous sector. Provided that the resulting particle number density and volume fraction are of the correct order of magnitude, the use of such grain refiner can enable full-scale production of new steel grades, provided that they do not have a negative influence on the steelmaking process itself. WO 01/57280 describes a grain refinement alloy for steel containing between 0.001 and 2% by weight of oxygen or sulphur. Note that term alloy in this context means a metal-based grain refiner always being low in the non-metallic elements O and S.

However, in grain refinement of steel oxygen and sulphur are the key elements controlling the particle volume fraction and number density of the nucleating inclusions in the as-cast product. Thus, in order to achieve the desired degree of grain refinement during subsequent steel processing, the grain refining alloy described in WO 01/57280 must be added in amounts that, at least, exceed one percent by weight of the liquid steel melt. This level of addition is not acceptable in continuous casting of steels, where the maximum limit is typically 0.2 to 0.3% by weight of the liquid steel to avoid problems related to the dissolution and mixing of the grain refining alloy in the tundish or the casting mould. Addition of larger amounts (>0.5 wt %) of cold alloy in liquid steel will also cool the steel to an extent that it starts to freeze in the inlet die of the casting mould, thereby destroying the casting operation.

A breakthrough in the existing grain refinement technology is therefore required to fully exploit the potentials of the concept in industrial steelmaking. The object of the present invention is to transfer the technology to continuous casting of steels, which is the dominating casting method for wrought steel products, covering more than 90% of the world wide steel production.

SUMMARY OF THE INVENTION

As follows from the background art, much more concentrated grain refiners than the previously claimed grain refining alloys described in WO 01/57280 are needed to enable grain refinement of continuous cast steels by active inclusions. For example, to make them suitable for addition in the tundish or the casting mould their sulphur or oxygen content should be from 2 to 30% by weight or higher, preferably from 5 to 25% by weight, most preferred from 10 to 15% by weight. This requirement is not possible to meet using the conventional grain refining alloy technology disclosed in WO 01/57280. It follows that the new, highly concentrated grain refiners, which actually are particulate composites where the dispersed particles occupy between 30 to 70% of the total volume, can only be produced by means of smart design. According to the present invention, a new grain refiner design in combination with novel manufacturing methods will lead to further improvements of the grain refining technology through strict control of the particle size distribution in the composites, which along with the chemical composition controls their grain refining efficiency in both shaped castings and wrought steel products. Hence, compared to the existing grades of grain refiners described in WO 01/57280 (which are conventional alloys containing a limited number density of the nucleating particles), these new particulate composites represent the next generation of grain refiners in the sense that they are tailor-made for the purpose and can be used in the context of continuous casting of steels without interfering with the steelmaking process.

The present invention provides in a first aspect a material for grain refining of steel, wherein the material comprises a composition of the element(s) X and $X_aS_b$, (a and b are arbitrary positive numbers), where X is one or more elements selected from the group Ce, La, Pr, Nd, Y, Ti, Al, Zr, Ca, Ba, Sr, Mg, Si, Mn, Cr, V, B, Nb, Mo and Fe, and S is sulphur, wherein said material may additionally contain oxygen, carbon and nitrogen; and wherein the sulphur content is between 2 and 30% by weight of said material, while the total content of oxygen, carbon and nitrogen; and said other elements from group X is between 98 and 70% by weight of said material and the material is in the form of a composite material comprising non-metallic particles ($X_aS_b$) in a metallic matrix (X).

In an embodiment the sulphur content is between 10 and 15% by weight of said composite material, while the total content of oxygen, carbon and nitrogen; and said other elements from group X is between 90 and 85% by weight of said composite material. In another embodiment the sulphur content is between 10 and 15% by weight of said composite material, the content of oxygen, carbon and nitrogen is less than 0.1% by weight of said composite material, and said composite material further comprising balanced levels of said other elements from group X. X may be at least one element selected from the group Ce, La, Pr, Nd, Al and Fe.

In a second aspect the present invention provides a material for grain refining of steel, wherein the composite has a composition of the element(s) X and $X_aO_b$, (a and b are arbitrary positive numbers), where X is one or more elements selected from the group Ce, La, Pr, Nd, Y, Ti, Al, Zr, Ca, Ba, Sr, Mg, Si, Mn, Cr, V, B, Nb, Mo and Fe, and O is oxygen, wherein said material may additionally contain sulphur, carbon and nitrogen; and the oxygen content is between 2 and 30% by weight of said material, while the total content of sulphur and other elements from group X is between 98 and 70% by weight of said material and the material is in the form of a composite material comprising non-metallic particles ($X_aO_b$) in a metallic matrix (X). The oxygen content is preferably between 10 and 15% by weight of said composite material, while the total content of sulphur, carbon and nitrogen; and said other elements from group X is preferably between 90 and 85% by weight of said composite material. In a further embodiment the oxygen content is between 10 and 15% by weight of said composite material, whereas the content of sulphur, carbon and nitrogen is less than 0.1% by weight of said composite material, and said composite material further comprising balanced levels of said other elements from group X. Said X element may in a further embodiment be at least one element selected from the group Y, Ti, Al, Mn, Cr and Fe.

The composite materials contain at least $10^7$ of the $X_aS_b$ or $X_aO_b$ containing dispersion particles per $mm^3$ of said composite material (a and b are arbitrary positive numbers). Said $X_aS_b$ or $X_aO_b$ containing dispersion particles may further have a mean particle diameter $\bar{d}$ in the range from 0.2 to 5 μm and a total spread in the particle diameters from $d_{max}<10\times\bar{d}$ and $d_{min}>0.1\times\bar{d}$ ($d_{max}<50$ μm, $d_{min}>0.02$ μm).

In a further embodiment, said $X_aS_b$ or $X_aO_b$ containing dispersion particles may have a mean particle diameter $\bar{d}$ between 0.5 and 2 μm, where the spread in the particle diameters should not exceed the limits $d_{max}<5\times\bar{d}$ and $d_{min}>0.2\times\bar{d}$ ($d_{max}<10$ μm, $d_{min}>0.1$ μm).

In an even further embodiment, said $X_aS_b$ or $X_aO_b$ containing dispersion particles have a mean particle size of about 1 μm and a maximum spread in the particle diameters ranging from 0.2 to 5 μm and containing about $10^9$ particles per $mm^3$. In another embodiment, said $X_aS_b$ or $X_aO_b$ containing dispersion particles have a mean particle size of about 2 μm and a maximum spread in the particle diameters ranging from 0.4 to 10 μm.

The composite material preferably comprises $X_aS_b$ or $X_aO_b$ containing dispersion particles, which are either spherical or faceted single phase or multiphase crystalline compounds. Said $X_aS_b$ or $X_aO_b$ containing particles may also comprise at least one secondary phase of the $X_aC_b$ or $X_aN_b$ type at the surface, and may comprise at least one of the following crystalline phases: CeS, LaS, MnS, CaS, $Ti_aO_b$, $AlCeO_3$, $\gamma$-$Al_2O_3$, $MnOAl_2O_3$, $Y_2O_3$, $Ce_2O_3$, $La_2O_3$, TiN, BN, CrN, AlN, $Fe_a(B,C)_b$, V(C, N), Nb(C, N), $B_aC_b$, TiC, VC or NbC.

In a third aspect the invention provides a method for grain refinement of steel, wherein a grain refining composite material comprises a composition of the element(s) X and $X_aS_b$, where X is one or more elements selected from the group Ce, La, Pr, Nd, Y, Ti, Al, Zr, Ca, Ba, Sr, Mg, Si, Mn, Cr, V, B, Nb, Mo and Fe, and S is sulphur, wherein said composite material may additionally contain oxygen, carbon and nitrogen; wherein the sulphur content is between 2 and 30% by weight of said composite material, while the total content of oxygen and said other elements from group X is between 98 and 70% by weight of said composite material, is added to a liquid steel in an amount of between 0.05 to 5% by weight of the steel, whereafter the steel is cast, either continuously or batch-wise.

In a fourth aspect the invention provides a method for grain refinement of steel, wherein a grain refining composite material having a composition of the element(s) X and $X_aO_b$, where X is one or more elements selected from the group Ce, La, Pr, Nd, Y, Ti, Al, Zr, Ca, Ba, Sr, Mg, Si, Mn, Cr, V, B, Nb, Mo and Fe, and O is oxygen, wherein said composite material may additionally contain sulphur, carbon and nitrogen; and the oxygen content is between 2 and 30% by weight of said composite material, while the total content of sulphur, carbon and nitrogen; and other elements from group X is between 98 and 70% by weight of said composite material is added to a liquid steel in an amount of between 0.05 to 0.5% by weight of the steel, whereafter the steel is cast, either continuously or batch-wise.

In one embodiment the invention provides a method for grain refinement of steel, wherein the grain refining composite material contains about $10^9$ particles per $mm^3$ of composition $X_aS_b$ or $X_aO_b$, with a mean particle size of about 1 μm and a maximum spread in the particle diameters ranging from 0.2 to 5 μm. The corresponding volume fraction of particles in the composite material is about 0.5. Preferably, this said composite material is added to liquid steel in an amount of about 0.3% by weight of the liquid steel prior to continuous casting of the steel, yielding a typical number density of the dispersed particles in the steel melt of approximately $3\times10^6$ particles per $mm^3$. This particle number density is sufficiently high to provide the desired grain refinement effect in the finished steel. The said composite material is preferably added to a clean steel melt having a total sulphur and oxygen content less than 0.002% by weight of the steel prior to addition.

The composite material may be added to the liquid steel in the form of a cored wire having an aluminium casing, in the form of a cored wire further comprising crushed Si or FeSi particles, or may be added to the molten steel in the ladle or the tundish just before or during casting, or added to the molten steel in the casting mould.

In a fifth aspect the invention provides a method for producing a grain refining composite material for steel, where said composite material comprising a composition of the element(s) X and $X_aS_b$, the method comprising the following steps:

mixing at least one X element selected from the group Ce, La, Pr, Nd, Y, Ti, Al, Zr, Ca, Ba, Sr, Mg, Si, Mn, Cr, V, B, Nb, Mo and Fe, with a sulphur source and potentially an oxygen source, obtaining a mixture;

melting said mixture in a furnace under the shield of a protective gas;

superheating the melted mixture; and quenching the superheated melt at a rate of at least 500° C./sec to achieve a composite material wherein the sulphur content is between 2 and 30% by weight of said composite material, while the total content of oxygen and said other elements from group X is between 98 and 70% by weight of said composite material.

When the at least one X element is selected from the group Ce, La, Pr and Nd, the shielding gas may be nitrogen, argon or helium, and quenching being performed by melt spinning or gas atomising.

In a sixth aspect the invention also provides a method for producing a grain refining composite material for steel, where said composite material comprising a composition of the element(s) X and $X_aO_b$, the method comprising the following steps:

mixing at least one X element selected from the group Ce, La, Pr, Nd, Y, Ti, Al, Zr, Ca, Ba, Sr, Mg, Si, Mn, Cr, V, B, Nb, Mo and Fe, and an oxide source and potentially a sulphur source, obtaining a mixture;

compacting said mixture providing pellets; and reducing said pellets in a controlled atmosphere at temperatures between 600 and 1200° C. to remove excess oxygen from said pellets providing a composite material of stable oxides in a metal matrix, wherein the oxygen content is between 2 and 30% by weight of said composite material, while the total content of oxygen and said other elements from group X is between 98 and 70% by weight of said composite material. When at least one X element is selected from the group Mg, Ti, Al, Mn, Cr and Fe, and said pellets may be reduced in a gas atmosphere containing CO and/or $H_2$, providing a composite material of stable oxides in a matrix of iron. The atmosphere may further contain $N_2$.

BRIEF DESCRIPTION OF DRAWINGS

Embodiments of the invention will now be described with reference to the drawings, where:

FIG. 1 is a schematic drawing of a metallographic section of a PCGR according to an embodiment of the invention showing the particles (black spots) with grain refining capabilities embedded in the parent matrix material (grey regions);

FIG. 2 is a schematic drawing showing the morphology and multiphase crystalline nature of the particles contained in the PCGRs;

FIG. 3 shows a definition of the three parameters used to characterise the size distribution of particles within the PCGRs;

FIG. 4 provides an overview of the different methods used to produce the PCGRs according to an embodiment of the present invention; (a) The melting & quenching route, (b) The powder metallurgy route;

FIG. 5 is an optical micrograph of the manufactured CeS-based PCGR according to an embodiment of the invention showing yellow CeS particles embedded in a matrix of Ce+Fe; and FIG. 6 showing a line scan through a partly reduced ilmenite particle according to an embodiment of the invention showing formation of a metal shell around an oxide core.

DETAILED DESCRIPTION

The present invention relates to the manufacturing and use of novel particulate composites comprised of non-metallic particles in a metallic matrix, for grain refinement of steels, both ferritic and austenitic steels that are efficient enough to be used in a variety of casting operations, including continuous casting, ingot casting and near-net-shape casting of such steels. The Particulate Composite Grain Refiners (in the following abbreviated PCGRs) are characterised by:

Their content of sulphur and oxygen which are represented by the chemical symbols S and O for formation of primary constituent phases and their content of carbon and nitrogen which are represented by the chemical symbols C and N for formation of secondary constituent phases.

Their content of other alloying and impurity elements, as represented by the collective symbol X, where X is one or more elements selected from the group Ce, La, Pr, Nd, Y, Ti, Al, Zr, Ca, Ba, Sr, Mg, Si, Mn, Cr, V, B, Nb, Mo and Fe The resulting volume fraction f, number density $N_v$, and size distribution of the dispersed particles of chemical composition $X_aS_b$ or $X_aO_b$, (where a and b represent arbitrary positive numbers), as determined by the total content of the elements S, O, C, N and X in the PCGRs.

The resulting chemistry and crystal structure of primary and secondary constituent phases (i.e. $X_aS_b$, $X_aO_b$, $X_aC_b$ and $X_aN_b$) within the dispersed particles, as determined by the total content of the non-metallic elements S, O, C, N and X in the PCGRs.

In the present invention the term composite material is used. Composite materials are engineered materials made from two or more constituent materials that remain separate and distinct on a microscopic level, while macroscopically forming a single component. There are two categories of constituent materials; matrix and particles. The matrix material surrounds and protects the dispersed particles during dissolution of the grain refiners in the liquid steel so that the particles do not cluster or agglomerate in the melt. In the present invention these particles are also referred to as dispersoids, which during solidification and subsequent thermo-mechanical processing of the steel act as potent heterogeneous nucleation sites for the iron crystals. This is in contrast to the grain refining alloy described in WO 01/57280, which is metal-based containing low levels of the non-metallic elements O and S (less than 2% by weight). Thus, the successful use of the grain refining alloys rely on that these elements already are present in the liquid steel in sufficient amounts to facilitate the formation of the catalyst phases, prior to addition of the grain refiners to the steel melt.

A more detailed description of the PCGRs is given below.

2. Particulate Composites for Grain Refinement of Steel 2.1 Chemical Composition of PCGRs The present invention relates to the manufacturing and use of PCGRs for steels with the elements X and S or O. In the (first) sulphur-based PCGRs, the sulphur content is between 2 and 30% by weight of the grain refiner, while the total content of O and other elements from group X is between 98 and 70% by weight of the grain refiner. Similarly, in the oxygen-based PCGRs, the oxygen content is between 2 and 30% by weight of the grain refiner, whereas the total content of S and other elements from group X is between 98 and 70% by weight of the grain refiner. In particular, the use of a grain refining composite material having a high content of sulphur and oxygen offers the special advantage of providing a strong grain refinement effect also at low levels of additions (i.e. less than 0.5% by weight of the liquid steel). This is an overriding concern that must be met in the case of continuous casting of steel to avoid dissolution, mixing and freezing problems in the tundish or the mould, as explained earlier.

According to a preferred embodiment the sulphur-based PCGRs should contain between 10 and 15% by weight of sulphur, while the total content of O and other elements from group X should be between 90 and 85% by weight of the grain refiner. According to another preferred embodiment the same sulphur-based PCGRs, characterised by a sulphur content of 10 and 15% by weight, should contain less than 0.1 weight percent of oxygen and balanced levels of other elements from group X.

Similarly, according to a preferred embodiment the oxygen-based PCGRs should contain between 10 and 15% by weight of oxygen, while the total content of S and other elements from group X should be between 90 and 85% by weight of the grain refiner. According to another preferred embodiment the same oxygen-based PCGRs, characterised by an oxygen content of 10 and 15% by weight, should contain less than 0.1 weight percent of sulphur and balanced levels of other elements from group X.

2.2 Constituent Elements and Phases in Embedded Particles

In the PCGRs, the $X_aS_b$ or $X_aO_b$ containing particles are embedded in a matrix containing the remaining levels of the elements (a and b represent arbitrary positive numbers). These matrix elements are either present in the form of a solid solution or as separate metallic and intermetallic compounds. FIG. 1 shows a schematic drawing of a metallographic section of a PCGR, revealing the particles of the $X_aS_b$ or $X_aO_b$ type embedded in the parent matrix material.

The $X_aS_b$ or $X_aO_b$ containing particles can either be spherical or faceted single phase or multiphase crystalline compounds, as shown schematically in FIG. 2. In addition, they may contain one or several secondary phases of the $X_aC_b$ or $X_aN_b$ type at the surface. In each case the different constituent phases have a unique chemical composition with a well-defined crystal structure that can be determined by X-ray diffraction employing high resolution electron microscopy.

The particles within the PCGRs should contain at least one of the following crystalline phases: CeS, LaS, MnS, CaS, $Ti_aO_b$, $Y_2O_3$, $AlCeO_3$, $\gamma$-$Al_2O_3$, $MnOAl_2O_3$, $Ce_2O_3$, $La_2O_3$, TiN, BN, CrN, AlN, $Fe_a(B, C)_b$, V(C, N), Nb(C, N), $B_aC_b$, TiC, VC or NbC.

2.3 Size Distribution of Particles in the PCGRs

In order to maximise their grain refining efficiency in steel without compromising toughness, the particles in the PCGRs should have a well-defined size distribution being characterised by the mean particle diameter $\bar{d}$ and further by the maximum $d_{max}$ and the minimum $d_{min}$ particle diameters within the distribution. These parameters, which are defined in FIG. 3, are measured experimentally by employing optical or high resolution electron microscopy.

The particle distribution in the PCGRs is characterised by a mean particle diameter $\bar{d}$ varying in the range from 0.2 and 5 μm and a total spread in the particle diameters varying from $d_{max}<10\times\bar{d}$ and $d_{min}>0.1\times\bar{d}$.

According to a preferred embodiment the particle distribution in the PCGRs should yield a mean particle diameter $\bar{d}$ between 0.5 and 2 μm, where the spread in the particle diameters should not exceed the limits $d_{max}<5\times\bar{d}$ and $d_{min}>0.2\times\bar{d}$.

2.4 Volume Fraction and Number Density of Particles in the PCGRs

The particle volume fraction f is related to the total content of sulphur and oxygen in the PCGRs through the equation:

$$f=0.033\times(\%\,S+\%\,O) \tag{1}$$

where the concentration of the elements S and O is given in weight percent.

The total number of particles per unit volume $N_v$ in the PCGRs is, in turn, calculated from the relationship:

$$N_v = \frac{6f}{\pi\,\bar{d}^3} \tag{2}$$

It follows from the previous compositional and size distribution requirements that an optimised PCGR typically contains about $10^9$ particles per $mm^3$, with a mean particle size of about 1 μm and a maximum spread in the particle diameters ranging from 0.2 to 5 μm. The corresponding volume fraction of particles in the PCGR is about 0.5. When such grain refiners are added to liquid steel at a level of 0.3% by weight of the steel, the corresponding particle number density in the steel melt is approximately $3\times10^6$ particles per $mm^3$. The latter number density is sufficiently high to promote extensive grain refinement during subsequent steel processing, provided that the catalyst crystalline phases, as specified above, are present at the surface of the particles.

3. Manufacturing of the PCGRs

There are two different ways the PCGRs can be produced, as illustrated in FIG. 4. The melting & quenching route means that the different components first are mixed and melted in a furnace under the shield of a protective gas (e.g. nitrogen, argon or helium) and then superheated to make sure that all elements, including S and O, are in solution. This superheated melt is then rapidly quenched (more than 500° C./second) to achieve the desired distribution of the particles in the PCGRs. Alternatively, a powder metallurgy route can be employed. The value-added DRI (Direct Reduced Iron) method involves mixing of iron oxide powder (optionally iron powder) with other metals or oxides. The pellets made from these blends are subsequently reduced in a controlled atmosphere at temperatures between 600° C. and 1200° C. to remove excess oxygen from the components using $H_2$, CO or $CH_4$, leaving behind a fine dispersion of stable oxides in the iron matrix. Alternatively, the desired particle size distribution can be obtained by performing a solution heat treatment of the mixed components in a controlled atmosphere followed by artificial ageing at some lower temperature to bring out the particles through precipitation.

According to a preferred embodiment the sulphur-based PCGRs should be made by mixing one or several of the rare earth metals Ce, La, Pr or Nd with an appropriate sulphur source (e.g. FeS or $Ce_2S_3$) along with some Al (optional). The mixture is then melted in a chemically inert Ta or BN crucible under the shield of Ar. After superheating (50 to 200° C. above its melting point), the melt is rapidly quenched (more than 500° C./second) either through melt spinning or by gas atomising, to obtain the desired size distribution and number density of the rare earth sulphide particles in the PCGRs as outlined in section 2.3.

Similarly, according to a preferred embodiment the oxygen-based PCGRs should be made from a high-purity oxides (e.g. $FeTiO_3$, $FeMn_2O_4$, $FeCr_2O_4$ or $FeAl_2O_4$) of proper sizing (in the range +0.5 μm-5 μm). Following compacting of the mineral powder, the pellets should be reduced at temperatures between 600° C. and 1200° C. in a gas atmosphere containing CO and/or $H_2$ to obtain a fine dispersion of the remaining oxide component (e.g. $Ti_aO_b$, $Mn_aO_b$, $Cr_2O_3$ or $Al_2O_3$) in a matrix of iron. According to another preferred embodiment the same oxygen-based PCGRs should be made by addition of $N_2$ to the gas atmosphere to promote the formation of specific types of nitrides such as TiN, CrN or AlN at the surface of the oxide particles.

3. Efficient Use of the PCGRs in Industrial Steelmaking

Efficient use of the PCGRs in industrial steelmaking involves the following steps and procedures.

3.1 Pre-Treatment of the Liquid Steel

The liquid steel should be properly deoxidised and desulphurised prior to the addition of the PCGRs. At the same time the inclusions which form as a result of these reactions should be allowed to separate out from the steel bath before the addition is made. Moreover, the steel composition should be properly adjusted prior to the addition of the PCGRs to ensure that the particles being added via the grain refiners are thermodynamically stable in their new environment. Conversely, if the initial distribution of the particles contained in the PCGRs is either finer or coarser compared to the target distribution in the as-cast steel, the liquid steel composition should be manipulated to make the particles grow or partially dissolve in a controlled manner. It is also possible by proper pre-treatment of the liquid steel to change the chemistry and crystal structure of the particles added via the PCGRs by promoting an exchange reaction between the particles and the liquid steel. In this case the exchange reaction implies that the original metallic component in the $X_aS_b$ or $X_aO_b$ is replaced by another metallic component within the same group of the X elements, which already is contained in the steel melt (for example by replacing Mn with Ce according to the overall reaction Ce+MnS=CeS+Mn).

According to a preferred embodiment the PCGRs should be added to a clean steel melt, characterised by a total sulphur and oxygen content less than 0.002% by weight of the steel prior to the addition. A clean steel melt is desirable as oxygen and sulphur in the liquid steel may affect on the particles added.

3.2 Methods of Addition of PCGRs to Liquid Steel

The PCGRs should be added to the liquid steel either in a powder form, as pellets or as thin ribbons or chips of proper sizing to ensure a fast dissolution and mixing of the different components into the steel melt.

According to a preferred embodiment of the sulphur-based PCGRs, these should be added to the liquid steel via a cored wire. According to another preferred embodiment the cored wired should have an aluminium casing. According to yet another preferred embodiment crushed Si or FeSi particles should be mixed into the cored wire along with the PCGR to ease the dissolution and mixing of the different components into the liquid steel by providing local exothermic superheating of the steel melt.

According to a preferred embodiment of the oxygen-based PCGRs, these should be added to the liquid steel as pellets.

3.3 Level of Addition of PCGRs to Liquid Steel

The PCGRs should be added to liquid steel at a level varying in the range from 0.05 to 5% by weight of the liquid steel to provide favourable conditions for grain refinement. During subsequent solidification, grain refinement of the steel takes place by a process of epitaxial nucleation of ferrite or austenite crystals at the dispersed particles added via the grain refiner. In the solid state it occurs through a process of heterogeneous nucleation of ferrite or austenite at the same particles.

According to a preferred embodiment the amount of addition of the PCGRs to the liquid steel prior to continuous casting should be in the range from 0.1 to 0.5% by weight of the steel, and preferably between 0.2 to 0.3%. The addition should be made either in the tundish or the casting mould to avoid extensive growth or coarsening of the dispersed particles added via the grain refiner.

Example 1

Manufacturing of a CeS Based PCGR

The CeS based PCGR shown in FIG. 5 was produced by the melting and quenching route in the laboratory. As a starting point small chips of Ce metal was mixed with FeS to achieve the target sulphur content of about 5% by weight. This mixture was then melted and superheated (~100° C. above its melting point) in a Ta crucible under the shield of pure argon using induction heating. Following superheating the melt was rapidly quenched against a fast rotating copper wheel. The subsequent metallographic examination of the chilled metal ribbons revealed a very fine dispersion of CeS particles being embedded in a matrix of Ce+Fe, as shown by the optical micrograph in FIG. 5. In this case the mean diameter $\bar{d}$ of the CeS particles was found to be about 2 μm, with the maximum and minimum particle diameters being within the limits $d_{max}$<10 μm and $d_{min}$>0.4 μm, respectively.

Example 2

Manufacturing of a $Ti_mO_n$ Based PCGR

FIG. 6 is a line scan through a particle of partly reduced ilmenite ($FeTiO_3$) showing formation of a metal shell around an oxide centre. It can be seen that the iron in the ilmenite diffuse out to the grain surface and the titanium is left behind in the form of rutile ($TiO_2$). The starting material is ilmenite pellets made from ilmenite ore grains, oxidized at 800° C. in air, and subsequently reduced at 950° C. in an atmosphere of 99 vol % CO(g) and 1 vol % $CO_2$(g). The reduction was discontinued after 2 hours at a stage where about 50% of the iron contained in the ilmenite was converted to metallic iron to show the transport of iron to the particle surface. On further reduction the outer metallic shell as well as the rutile will increase at the expense of the ilmenite core, giving an end product essentially consisting of a rutile core surrounded by metal.

Having described preferred embodiments of the invention it will be apparent to those skilled in the art that other embodiments incorporating the concepts may be used. These and other examples of the invention illustrated above are intended by way of example only and the actual scope of the invention is to be determined from the following claims.

The invention claimed is:

1. A material for grain refining of steel, wherein the material is in the form of a composite material comprising non-metallic particles $X_aS_b$ in a metallic matrix X, where X is one or more elements selected from the group consisting of Ce, La, Pr, Nd, Y, Ti, Al, Zr, Ca, Ba, Sr, Mg, Si, Mn, Cr, V, B, Nb, Mo and Fe, and S is sulphur, wherein said material further comprises oxygen, carbon and nitrogen, wherein the sulphur content is between 5 and 25% by weight of said material, while the total content of oxygen, carbon and nitrogen and said other elements from group X is between 95 and 75% by weight of said material, wherein said composite material contains at least $10^7$ $X_aS_b$ containing particles per $mm^3$ of said composite material, and wherein said $X_aS_b$ containing dispersion particles have a mean particle diameter $\bar{d}$ in the range from 0.2 to 5 μm and a total spread in the particle diameters from:

$$d_{max}<10\times\bar{d} \text{ and } d_{min}>0.1\times\bar{d}(d_{max}<50\ \mu m, d_{min}>0.02\ \mu m).$$

2. The material according to claim 1, wherein the sulphur content is between 10 and 15% by weight of said composite material, while the total content of oxygen, carbon and nitrogen and said other elements from group X is between 90 and 85% by weight of said composite material.

3. The material according to claim 1, wherein the sulphur content is between 10 and 15% by weight of said composite material, the content of oxygen, carbon and nitrogen is less than 0.1% by weight of said composite material, and the balance of said composite material from elements of group X.

4. The material according to claim 1, wherein said X is one or more elements selected from the group consisting of Ce, La, Pr, Nd, Al and Fe.

5. The material according to one of claims 1-4, wherein said $X_aS_b$ containing particles have a mean particle diameter $\bar{d}$ between 0.5 and 2 μm, where the spread in the particle diameters does not exceed the limits $$d_{max}<5\times\bar{d} \text{ and } d_{min}>0.2\times\bar{d}(d_{max}<10\ \mu m, d_{min}>0.1\ \mu m).$$

6. The material according to one of claims 1-4, wherein said $X_aS_b$ containing particles have a mean particle size of about 1 μm and a maximum spread in the particle diameters ranging from 0.2 to 5 μm and containing about $10^9$ particles per $mm^3$.

7. The material according to one of claims 1-4, wherein said $X_aS_b$ containing particles have a mean particle size of about 2 μm and a maximum spread in the particle diameters ranging from 0.4 to 10 μm.

8. The material according to one of claims 1-4, wherein said $X_aS_b$ containing particles are either spherical or faceted single phase or multiphase crystalline compounds.

9. The material according to one of claims 1-4, wherein said $X_aS_b$ containing particles comprises at least one secondary phase of an $X_aC_b$ or $X_aN_b$ type at a surface of said composite material, wherein C is carbon, N is nitrogen and X is as defined in claim 1.

10. The material according to one of claims 1-4, wherein said $X_aS_b$ containing particles comprises at least one of the following crystalline phases: CeS, LaS, MnS, CaS, $Ti_aO_b$, $AlCeO_3$, γ-$Al_2O_3$, $MnOAl_2O_3$, $Ce_2O_3$, $La_2O_3$, $Y_2O_3$, TiN, BN, CrN, AlN, $Fe_a(B,C)_b$, V(C, N), Nb(C, N), $B_aC_b$, TiC, VC or NbC.

11. A method of producing a grain refining composite material for steel, where said composite material comprises a composition of non-metallic particles $X_aS_b$ and a metallic matrix X, said method comprising the following steps: (melting and quenching)

mixing at least one X element selected from the group consisting of Ce, La, Pr, Nd, Y, Ti, Al, Zr, Ca, Ba, Sr, Mg, Si, Mn, Cr, V, B, Nb, Mo and Fe, with a sulphur source and potentially an oxide source, obtaining a mixture;

melting said mixture in a furnace under the shield of a protective gas;

superheating the melted mixture; and quenching (more than 500° C./sec) the superheated melt to achieve a composite material wherein the sulphur content is between 5 and 25% by weight of said composite material, while the total content of oxygen, carbon and nitrogen and said other elements from group X is between 95 and 75% by weight of said composite material, wherein said composite material contains at least $10^7$ $X_aS_b$ containing particles per $mm^3$ of said composite material, and wherein said $X_aS_b$ containing dispersion particles have a mean particle diameter $\bar{d}$ in the range from 0.2 to 5 μm and a total spread in the particle diameters from $d_{max}<10\times\bar{d}$ and $d_{min}>0.1\times\bar{d}$ ($d_{min}<50$ μm, $d_{min}>0.02$ μm).

12. The method according to claim 11, wherein X is selected from the group consisting of Ce, La, Pr and Nd, wherein the protective gas is nitrogen, argon or helium, and wherein quenching is performed by melt spinning or gas atomising.

13. A method for grain refinement of steel, comprising adding a grain refining composite material comprising a composition of non-metallic particles $X_aS_b$ and a metallic matrix X, where X is one or more elements selected from the group consisting of Ce, La, Pr, Nd, Y, Ti, Al, Zr, Ca, Ba, Sr, Mg, Si, Mn, Cr, V, B, Nb, Mo and Fe, and S is sulphur, wherein said composite material further comprises oxygen, carbon and nitrogen wherein the sulphur content is between 5 and 25% by weight of said composite material, while the total content of oxygen, carbon and nitrogen and said other elements from group X is between 95 and 75% by weight of said composite material, wherein said composite material contains at least $10^7$ $X_aS_b$ containing particles per $mm^3$ of said composite material, and wherein said $X_aS_b$ containing dispersion particles have a mean particle diameter $\bar{d}$ in the range from 0.2 to 5 μm and a total spread in the particle diameters from $d_{max}<10\times\bar{d}$ and $d_{min}>0.1\times\bar{d}$ ($d_{max}<50$ μm, $d_{min}>0.02$ μm) to a liquid steel in an amount of between 0.05 to 5% by weight of the steel, and then casting the steel either continuously or batchwise.

14. The method according to claim 13, wherein the composite material is added to liquid steel in an amount of between 0.1 to 0.5% by weight of the steel prior to continuous casting of the steel.

15. The method according to claim 13, wherein a composite material containing about $10^9$ particles per $mm^3$ is added to liquid steel in an amount of about 0.3% by weight of the liquid steel prior to continuous casting of the steel, thereby providing a number density of the dispersed particles in the steel melt of approximately $3\times10^6$ particles per $mm^3$.

16. The method according to claim 13, wherein the composite material is added to a clean steel melt having a total sulphur and oxygen content less than 0.002% by weight of the steel prior to addition.

17. The method according to claim 13, wherein the composite material is added to the liquid steel either in a powder form, as pellets or as thin ribbons or chips.

18. The method according to claim 13, wherein the composite material is added to the liquid steel in the form of a cored wire, having an aluminium casing.

19. The method according to claim 13, wherein the composite material is added to the liquid steel in the form of a cored wire further comprising crushed Si or FeSi particles.

20. The method according to claim 13, wherein the composite material is added to the molten steel in a ladle or a tundish just before or during casting.

21. The method according to claim 13, wherein the composite material is added to the molten steel in a casting mould.

* * * * *

UNITED STATES PATENT AND TRADEMARK OFFICE

CERTIFICATE OF CORRECTION

PATENT NO. : 8,486,175 B2
APPLICATION NO. : 12/227826
DATED : July 16, 2013
INVENTOR(S) : Oystein Grong et al.

It is certified that error appears in the above-identified patent and that said Letters Patent is hereby corrected as shown below:

In the Claims

In claim 11, column 12, lines 15-16, "$d_{max} < 10 \times \bar{d}$ and $d_{min} > 0.1 \times \bar{d}$ ($d_{min}$ <50 μm, $d_{min}$ >0.02 μm).", should read __ $d_{max} < 10 \times \bar{d}$ and $d_{min} > 0.1 \times \bar{d}$ ($d_{max}$ <50 μm, $d_{min}$ >0.02 μm).__

Signed and Sealed this
Fourth Day of August, 2015

Michelle K. Lee

Michelle K. Lee
*Director of the United States Patent and Trademark Office*